US011889931B2

(12) United States Patent
Schachtner

(10) Patent No.: US 11,889,931 B2
(45) Date of Patent: Feb. 6, 2024

(54) CARRYING DEVICE FOR BABIES OR SMALL CHILDREN

(71) Applicant: Schachtner Vermögensverwaltungs GmbH & Co. KG, Marburg-Schröck (DE)

(72) Inventor: Petra Schachtner, Marburg (DE)

(73) Assignee: Schachtner Vermögensverwaltungs GmbH & Co. KG, Marburg-Schröck (DE)

( * ) Notice: Subject to any disclaimer, the term of this patent is extended or adjusted under 35 U.S.C. 154(b) by 8 days.

(21) Appl. No.: 16/645,558

(22) PCT Filed: Aug. 29, 2018

(86) PCT No.: PCT/EP2018/073240
§ 371 (c)(1),
(2) Date: Mar. 9, 2020

(87) PCT Pub. No.: WO2019/048314
PCT Pub. Date: Mar. 14, 2019

(65) Prior Publication Data

US 2020/0297129 A1 Sep. 24, 2020

(30) Foreign Application Priority Data

Sep. 11, 2017 (DE) ..... 10 2017 120 964.6

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 15/00; A47D 13/00; A47D 13/02; A47D 15/006; A45F 3/047;
(Continued)

(56) References Cited

U.S. PATENT DOCUMENTS 6,182,873 B1 * 2/2001 Christopher ..... A47D 13/025 229/160
8,172,116 B1 5/2012 Lehan et al.
(Continued)

FOREIGN PATENT DOCUMENTS

CN 102648808 8/2012
DE 20 2014 100 616 6/2014
(Continued)

OTHER PUBLICATIONS

KR 20090008187 U Translation, 이현주 , Aug. 2009 (Year: 2009).*
(Continued)

*Primary Examiner* — Nathan J Newhouse
*Assistant Examiner* — Matthew T Theis
(74) *Attorney, Agent, or Firm* — Clark & Brody LP

(57) ABSTRACT

A carrying device has a receptacle member for receiving a baby or infant and a holding harness system with a hip strap for fastening the receptacle member to a person. The receptacle member has a central part for support and which is connected to the hip strap at a first connection point. The central part from an upper region narrows in the direction toward the hip strap, and, in the upper region, a first and second widening elements are connected to the central part. The first widening element extends to a second connection point to the hip strap, the second connection point being able to be adapted by displacing the first widening element along the hip strap. The second widening element extends to a third connection point to the hip strap, the third connection point being able to be adapted by displacing the second widening element along the hip strap.

22 Claims, 4 Drawing Sheets

(58) Field of Classification Search
CPC ..... A45F 3/04; A45F 2003/144; A45F 2003/045; A45F 3/08; A41D 2400/482
USPC ..... 224/160
See application file for complete search history.

(56) References Cited

U.S. PATENT DOCUMENTS

| | | | | |
|---|---|---|---|---|
| 8,636,181 | B2 * | 1/2014 | Gunter | A47D 13/025 224/159 |
| 8,701,949 | B1 | 4/2014 | Lehan et al. | |
| 2012/0298702 | A1 | 11/2012 | Jung et al. | |
| 2017/0150826 | A1 | 6/2017 | Salazar et al. | |
| 2017/0196374 | A1 * | 7/2017 | Chen | A47D 13/025 |
| 2018/0206653 | A1 * | 7/2018 | Andrus | A47D 13/025 |

FOREIGN PATENT DOCUMENTS

| | | | | |
|---|---|---|---|---|
| DE | 20 2016 103 901 | | 8/2016 | |
| GB | 2547423 | | 8/2017 | |
| GB | 2547423 | A * | 8/2017 | A47D 13/025 |
| JP | 2012-187352 | | 10/2012 | |
| JP | 2012187352 | A * | 10/2012 | A47D 13/025 |
| KR | 20-2009-0008187 | | 8/2009 | |
| KR | 20090008187 | U * | 8/2009 | |
| KR | 101 432 450 | | 8/2014 | |
| KR | 101432450 | B1 * | 8/2014 | |
| WO | 2009/034233 | | 3/2009 | |

OTHER PUBLICATIONS

KR 101432450 B1 Translation, Im Gwan Bin, Aug. 2014 (Year: 2014).*

* cited by examiner

CARRYING DEVICE FOR BABIES OR SMALL CHILDREN

The invention relates to a carrying device as claimed in the preamble of claim 1.

A carrying device having a receptacle member for receiving a baby or infant is known from DE 20 2007 006 204 U1. The receptacle member herein is configured so as to be height-adjustable such that at least one region of the rear side of a baby or infant is capable of being received and/or supported in said receptacle member, this preventing the newborn from sinking or sliding downward. On account of the carrying device having a holding harness system for fastening the receptacle member to a person and the receptacle member being height-adjustable, sufficient support of the back of the infants is guaranteed from birth until infant age. Such a construction achieves a carrying device in which a baby or an infant can be held between the receptacle member and selectively the back or the chest of the carrier, wherein the contact pressure required to this end is generated in that the shoulder straps, the waist strap, and the chest strap are closed and correspondingly adjusted.

In order for an orthopedically correct hip position, also referred to as the spread-squat position or the M-position®, to be achieved in the case of dissimilar sizes a seat size reduction is provided in the receptacle member. In the first weeks, the child is received in the seat size reduction that is disposed so as to be higher in the receptacle member. It is only later that the child sits in the receptacle member without the seat size reduction. It is disadvantageous that only two dissimilar spread positions can be assumed.

It is described in U.S. Pat. No. 4,986,458 A how a receptacle member at the lower end thereof configures a sling across the entire width, the hip strap being guided through said sling. On account thereof, the receptacle member can be gathered or pulled apart on the hip strap. The pulling-apart is performed by way of shoulder straps than are attached laterally to the receptacle member. A tension string which for delimiting the pulling-apart action has a clamp is disposed in a tunnel so as to be adjacent to the hip strap. The maximum width of the receptacle member is established as a function of how far the tension string is pulled out of the tunnel. On account thereof, the seat width and thus also the span between the hollows of the knees of child to be carried that bear thereon can be set. Large folds in the seat face below the child and in the region of the hollows of the knees which lead to bruises are disadvantageous. Moreover, the gathering on the hip strap presses uncomfortably on the carrier. A further disadvantage lies in the unfavorable distribution of pressure across the width of the child's posterior and lower back, said distribution of pressure significantly varying on account of the width being varied. A further disadvantage lies in that adjustment capability is restricted to the width of the rectangular blank of the receptacle member.

It is therefore an objective of the invention to overcome these and further disadvantages of the prior art and to achieve a comfortable carrying device which is suitable for receiving infants from birth up to infant age, wherein an orthopedically correct carrying mode is to be guaranteed for the infant as well as for the carrier. Furthermore, the carrying device is to be constructed in a simple and cost-effective manner and be easy to handle. Furthermore envisaged is an improved level of safety for the child to be received as well as for the carrier.

Major features of the invention are set forth in the characterizing part of claim 1. Design embodiments are the subject matter of claims 2 to 23.

The invention relates to a carrying device having a receptacle member which configures a receptacle space for receiving a baby or infant, and having a holding harness system for fastening the receptacle member to a person. The holding harness system has a hip strap. Moreover, the receptacle member has a central part which supports the baby or infant and which is connected to the hip strap at a first connection point. The central part herein from an upper region narrows in the direction toward the hip strap. Preferably, the blank of the central part per se narrows. In the upper region a first and a second widening element are connected to the central part, preferably so as to be horizontally mutually spaced apart, in particular on the external side, or laterally, respectively, or on the outer periphery in the upper region, and particularly preferably at horizontally opposite ends of the upper region. The first widening element extends to a second connection point to the hip strap, the position of said second connection point being able to be adapted by displacing, preferably in a stepless manner, the first widening element along the hip strap. Moreover, the second widening element extends to a third connection point to the hip strap, the position of said third connection point being able to be adapted by displacing, preferably in a stepless manner, the second widening element along the strap.

It is advantageous herein that widths of gaps between the first, the second, and the third connection point along the hip strap are able to be set. Folds on the hip strap are thus avoided, and the carrier can comfortably carry the carrying device without bruises. Since the tension of the central part is largely independent of the adjustment of the widening element, the child is uniformly supported at each setting, in particular in the region of the back, the hip, and the posterior. The widening elements support the thighs up to the hollows of the knees. It is achieved by way of the design embodiment that the central part is largely independent of the width adjustment, whereas the adaptation to the length of the thighs by means of the widening elements is rather extensive. This correlates with the growth of the infant, in which the width of the posterior, the pelvis, and the hip is comparatively small in comparison to the growth of the thighs. A narrowing of the seat can thus be effected on account of a longitudinal displacement of the first and the second widening element along the hip strap as well as in the direction of the first connection point. Conversely, a widening of the seat can be effected on account of a longitudinal displacement of the first and the second widening element along the hip strap as well as away from the first connection point. To this end, the first connection point should be disposed between the second and the third connection point. The central part is preferably not padded.

The receptacle member is configured in such a manner that at least one region of the rear side of a baby or infant can be received and/or supported in said receptacle member. The invention relates above all to a carrying device in which no additional element is disposed between the baby or infant and the carrier. A seat size reduction in the case of which the child is not supported from below by the central part is also not required.

The first and the second widening element in the upper region on the external side should in each case be connected in a non-adjustable, preferably also non-releasable, manner to the central part. This reduces the complexity of the adjustment. However, an adjustment capability of the length of the widening element is also conceivable. The height of the knees of the child could thus be set.

In principle, the hip strap has a longitudinal direction, an internal side, an external side, an upper edge, and a lower edge. The central part of the receptacle member is preferably connected to the upper edge of the hip strap. On account thereof, the load can be positively discharged to the hip of the carrier in a manner distributed across the hip strap. For this reason, the first and the second widening element should also extend in the direction of the upper edge of the hip strap.

According to one special design embodiment it is provided that one intermediate piece which does not have any connection, in particular fixed connection, to the hip strap is in each case tensioned between the first and the second widening element and the central part. The intermediate pieces protect the child from environmental influences such as wind, rain, sun, and cold. Moreover, the intermediate pieces in the wide position can assume an additional supporting function of the posterior and the thighs. The tensile stress of the intermediate pieces in the tight position is rather minor such that folds are unlikely to cause bruises. This is also facilitated when the external edges but not the internal edges of the widening elements are connected to the respective intermediate piece. The widening elements in this instance lie in each case on the internal side in front of the associated intermediate piece. The latter in this instance can create folds on the external side, wherein the child is in contact with the widening elements on the internal side. The widening elements are preferably more dimensionally stable than the intermediate pieces. The widening elements can in particular be padded. The intermediate pieces are preferably not padded.

In one preferred embodiment, the intermediate pieces widen in each case in the direction toward the hip strap. The intermediate pieces thus compensate for the narrowing of the central part, or may even overcompensate for the latter. Moreover, a triangular gap which can be filled by such an intermediate piece is in each case created between the central part and the widening elements when the widening elements are pulled apart. For this reason, a design embodiment in which the intermediate pieces have in each case a substantially triangular basic shape is expedient. One corner of the intermediate pieces on the internal side preferably extends in each case to below the upper edge of the hip strap, in particular into the region of the lower edge, and in particular on the internal side of the hip strap. On account thereof, the intermediate pieces when stressed are tensioned by way of the upper edge of the hip strap and are able to support the child. Moreover, the child is not in direct contact with the external side of the hip strap between the second and the third connection point.

In one special design embodiment the central part is connected to the hip strap in a non-adjustable, preferably also non-releasable, manner at the first connection point. On account thereof, a stable connection without interfering components which could cause bruises is achieved. A physically configured connection or connecting installation, respectively, for example a stitched seam or connecting elements, are in each case associated with the connection points.

A dimensional layout according to which the first connection point in the longitudinal direction of the hip strap is between 1 cm and 12 cm wide, preferably between 2 cm and 10 cm wide, furthermore preferably between 3 cm and 8 cm wide, even furthermore preferably between 4 cm and 7 cm wide, and particularly preferably between 4.5 cm and 6 cm wide, is expedient for receiving the child in an ergonomic manner. On account thereof, the centric support of the child from below is in particular ensured.

Furthermore, a dimensional layout in which the second and the third connection point are able to be displaced toward one another so far that external edges of the first and the second widening element in the region of the hip strap have a mutual spacing between 14 cm and 28 cm, furthermore preferably between 16 cm and 27 cm, even furthermore preferably between 18 cm and 26 cm, and particularly preferably between 20 and 24 cm is expedient. On account thereof, the thighs up to the hollows of the knees of still very small babies can in particular be correctly supported, in particular without said thighs being excessively spread.

A dimensional layout in such a manner that the second and the third connection point are able to be displaced toward one another so far that the external edges of the first and the second widening element converge in the direction toward the hip strap is particularly expedient. The spacing between the knee supports can thus be chosen to be small for comparatively small children, despite the receptacle member being wider in the upper region. On account thereof, the child is enveloped and protected. The external edges form the supports for the hollows of the knees.

In order to meet the requirements of comparatively large infants, a dimensional layout in which the second and the third connection point are able to be displaced outward so far that external edges of the first and the second widening element diverge in the direction toward the hip strap is moreover expedient. The thighs and knees are thus correctly held and supported in an orthopedically correct manner even in the case of a large spacing of the knees. At the same time, the envelope in the region of the upper back is comparatively narrower such that the infant can better communicate with the outside world and, for instance, can stretch its hands laterally out of the receptacle member.

In absolute terms, a dimensional layout in which the second and the third connection point are able to be longitudinally displaced so far from one another that external edges of the widening elements in the region of the hip strap have a mutual spacing between 30 cm and 55 cm, furthermore preferably between 35 cm and 50 cm, even furthermore preferably between 37 cm and 47 cm, and particularly preferably between 40 and 45 cm is advantageous.

A design embodiment in which the widening elements are in each case configured so as to be tape-shaped is expedient. A maximum width of 5 cm to 10 cm, and preferably 6 cm to 9 cm is particularly suitable as a tape width. The tape-shaped widening elements preferably narrow increasingly as the spacing from the associated connection point increases.

The lateral external edges of the receptacle member in the upper region preferably have a fixed spacing of 28 cm to 42 cm, furthermore preferably of 30 cm to 40 cm, and particularly preferably of 32 cm to 38 cm, for example 35 cm. The external-side connections between the first and the second widening elements to the central part preferably also lie in the region of said spacing.

In one special design embodiment it is furthermore provided that a stop beyond which the second and the third connection point are not able to be longitudinally displaced farther from one another is configured. The smallest possible setting is thus defined. The stop can be configured, for example, by a widening of the hip strap. Alternatively or additionally, a collision between the second and the third connection point and the first connection point is also to be considered.

In the case of one optional embodiment the second and the third connection point have in each case one sling which is disposed on the widening elements and is mounted so as to be displaceable on the hip strap. A stable, safe and simple connection is achieved on account thereof, without protruding hard components being required. The widening elements preferably transition to the slings. A positive and cost-effective connection is achieved on account thereof.

According to one special embodiment the slings in the longitudinal direction of the hip strap, as well as on the lower edge of the hip strap, are configured to be wide, preferably at least 2 cm, furthermore preferably at least 3 cm, even furthermore preferably at least 4 cm, and particularly preferably at least 5 cm wide. On account thereof, said slings do not cut into the hip strap. To this end, it is also expedient when the slings in the region of the lower edge of the hip strap on the internal side and on the external side in each case have substantially identical widths.

A design embodiment in which the slings in the region of the upper edge of the hip strap are in each case configured so as to be wider on the internal side of the hip strap than on the external side furthermore offers advantages. A collision with the first connection point can be avoided on account of this asymmetry. This is preferably performed in such a manner that the region of the slings that is disposed on the internal side as well as on the upper edge of the hip strap in the direction toward the first connection point projects beyond the region of the sling that is disposed on the external side as well as on the upper edge. This herein on the internal side can be the appendage of the adjacent widening element.

One special design embodiment therefore also provides that the slings on the internal side as well as on the upper edge of the hip strap are in each case connected to one of the widening elements.

The design embodiment of the slings should in particular be in such a manner that the first and the second widening element on the internal side of the hip strap are in each case able to be at least in part slid up to the first connection point. On account thereof, the seating region for the child can be set to be very narrow without the central part when pulling apart the widening elements being so narrow that said central part cuts in. It is achieved, so to speak, that the minimum spacing that is able to be set between the external edges of the first and the second widening element in the region of the hip strap corresponds substantially to the width of the first connection point plus the width of the slings on the external side in the region of the upper edge of the hip strap.

A design in which the first connection point is disposed in a depression of the upper edge of the hip strap is advantageous in terms of a high level of wear comfort, on account of which the optional slings are preferably inclined obliquely inward in the direction of the first connection point. The inward inclination enables the two widening elements to be slid tightly toward one another at the upper edge of the hip strap. Moreover, the tensile force of the slings acts by way of a more obtuse angle on the lower edge, the latter in the adjustment region preferably running parallel with the upper edge. This prevents slipping of the slings in the event of stress on the receptacle member.

In one comfortable embodiment the hip strap has a padded strap and an outer tension strap. Slipping and twisting of the slings in this instance can be prevented in particular by way of an arrangement in which the padded strap is disposed in the optional slings, and the tension strap lies outside the optional slings. The sling in this instance is jammed between the padded strap and the tension strap as soon as the carrier fixes the tension strap. To this end, the hip strap for opening and closing should have at least one closure element. In order for the level of safety to be increased, it can be provided that the at least one closure element is secured by a securing installation which prevents the hip strap being immediately released or opened, respectively, upon opening of the closure element. Such a securing installation can be configured in the manner of a sling, for example. This is simple in terms of handling and cost effective. The hip strap for adapting to the carrier should have a tensioning device.

In the case of one optional ergonomic design, the central part has a trapezoidal basic shape, wherein said trapezoidal basic shape is preferably an isosceles trapezoid, and wherein the shorter of the two base sides of the trapezoidal basic shape is preferably disposed in the region of the first connection point or configures a connecting edge of the first connection point.

In order for the central part to be tensioned in a dimensionally stable manner about the child to be received, an embodiment in which the central part, in particular in the horizontal direction, is tensioned between two tension cords which are connected to straps of the holding harness system is advantageous, wherein the tension cords preferably run up to the first connection point. The tension cords at least in portions, preferably however across the entire length, should be connected to the central part. The tension cords preferably lie on the lateral edges of the central part which converge in the direction of the first connection point. Moreover, the tension cords are preferably padded.

In order for the central part, or the receptacle member, respectively, to be tensioned in the vertical direction, the central part in the upper region should be connected indirectly or directly to two carrying straps of the holding harness system. On account thereof, the central part lies between the upper ends of the two carrying straps and the first connection point, and can be tensioned therebetween. The lower ends of the carrying straps preferably configure the straps that are connected to the two tension cords.

The two carrying straps are preferably shoulder straps. Said shoulder straps can run so as to be parallel or crossed. Embodiments having a fixed cruciform connection are also to be considered shoulder straps. In order to enable adapting to the carrier, the carrying belts should have at least one adjustment installation for varying the strap length. Comfort is preferably ensured in that the carrying straps at least in portions have shoulder pads. It can be provided as an additional adjustment function that the carrying straps for varying the effective length of the shoulder pads have at least one adjustment installation. Simple donning is achieved when the carrying straps optionally have closure elements for opening and closing the carrying straps. In order for the level of safety to be increased it can be provided in this instance that the closure elements are secured by a securing installation which prevents immediate releasing or opening, respectively, of the carrying straps upon opening a closure element. This can be achieved in that the securing installation is configured in the manner of a sling. The latter in particular in such a manner that the closure elements of the carrying straps, upon releasing said closure elements, catch on the securing installation configured in the manner of a sling. The shoulder straps in this instance are indeed already released. However, the child held by the carrying device cannot fall out of the latter.

The holding harness system can furthermore have a chest strap or back strap, respectively. Slipping of the carrying straps or shoulder straps, respectively, is prevented by such a chest strap or back strap, respectively. For adapting to the carrier, the chest strap or back strap, respectively, should have an adjustment installation for varying the strap length. The chest strap or back strap, respectively, should be fastened to the carrying straps. Moreover, the chest strap or back strap, respectively, should have a closure element for opening and closing the chest strap.

In one special design embodiment it is furthermore provided that a fixing installation by way of which the spacing of the widening elements, in particular from the hip strap, is able to be delimited. This facilitates the placing of very small children who are moreover so light and unstable that the pushed-together widening elements could otherwise slide out of position. According to a cost-effective and non-disturbing closer design embodiment, the fixing installation is configured by two string ends which can be knotted to one another and which are in each case fastened to one of the widening elements.

An optional refinement of the carrying device lies in that the receptacle member is configured in such a manner that the height thereof is variable. The carrying device can thus in particular also be adapted to the length of the back of the infant. It is thus possible to provide that the receptacle member has a length extension element which is able to be positioned in such a manner that the receptacle member, preferably between the central part and the two carrying straps, in the height direction is lengthened by the length extension element. The length extension element should be able to be adjusted between at least two positions, specifically a first position in which the height of the receptacle member is not increased, and a second position in which the height of the receptacle member is increased. The length extension element in the first position thereof can be able to be fixed by fixing means, for example. A variant in which the length extension element is an inward fold which is able to be fixed by fixing means is particularly simple in terms of handling. On account thereof, apart from the central part and the length extension element, a terminal portion which is connected to the carrying straps results. The fixing means can have a zip fastener and/or press studs and/or a hoop-and-loop fastener. In the case of a zip fastener, zip fastener strips are disposed at the top and the bottom on the length extension element such that the receptacle member is lengthened in the case of an opened zip fastener and is shortened in the case of a closed zip fastener. The length extension element is preferably configured, in particular from a common material web, so as to be integral to the central part.

A special design embodiment of the carrying device moreover provides that said carrying device has a head part. As soon as children grow, said children in this phase of growth like to look out of the receptacle member, which is why the head preferably protrudes from the top of the receptacle member. In the phase of sleep the head can be supported and protected by the optional head part. The head part can be a head part in the manner of a cloth or pad. The head part should be connected to the receptacle member in a releasable or fixed manner. The head part preferably has fastening elements which can be positioned on the holding harness system. The fastening elements should be configured in such a manner that said fastening elements can tension or gather the head part. The head part in the tensioned state can also serve as a parasol. Suitable fastening elements are, for example, a rubber sling or a rubber pull. Receptacle elements for receiving the fastening elements on the holding harness system should be disposed as counterparts. Said receptacle elements may be hooks. The receptacle elements are preferably disposed so as to be movable on the holding harness system, wherein said receptacle elements are configured in such a manner that said receptacle elements can selectively be fixed at various positions on the holding harness system. The head part can be adjusted on account thereof.

Particularly simple handling is achieved when the head part is able to be rolled up or folded up or gathered in the vertical direction, and one insertion pocket is in each case disposed at the horizontally lateral ends of the head part, the lateral ends of the head part being able to be inserted into said insertion pockets.

Overall, the receptacle member at least in portions should be configured in the manner of a cloth or pad. Above all, the widening elements, the tension cords, the central part, the intermediate pieces, and the length extension element should in each case be configured in the manner of a cloth or pad.

Further features, details, and advantages of the invention are derived from the wording of the claims as well as from the description hereunder of exemplary embodiments by means of the drawings in which:

Figure 1:
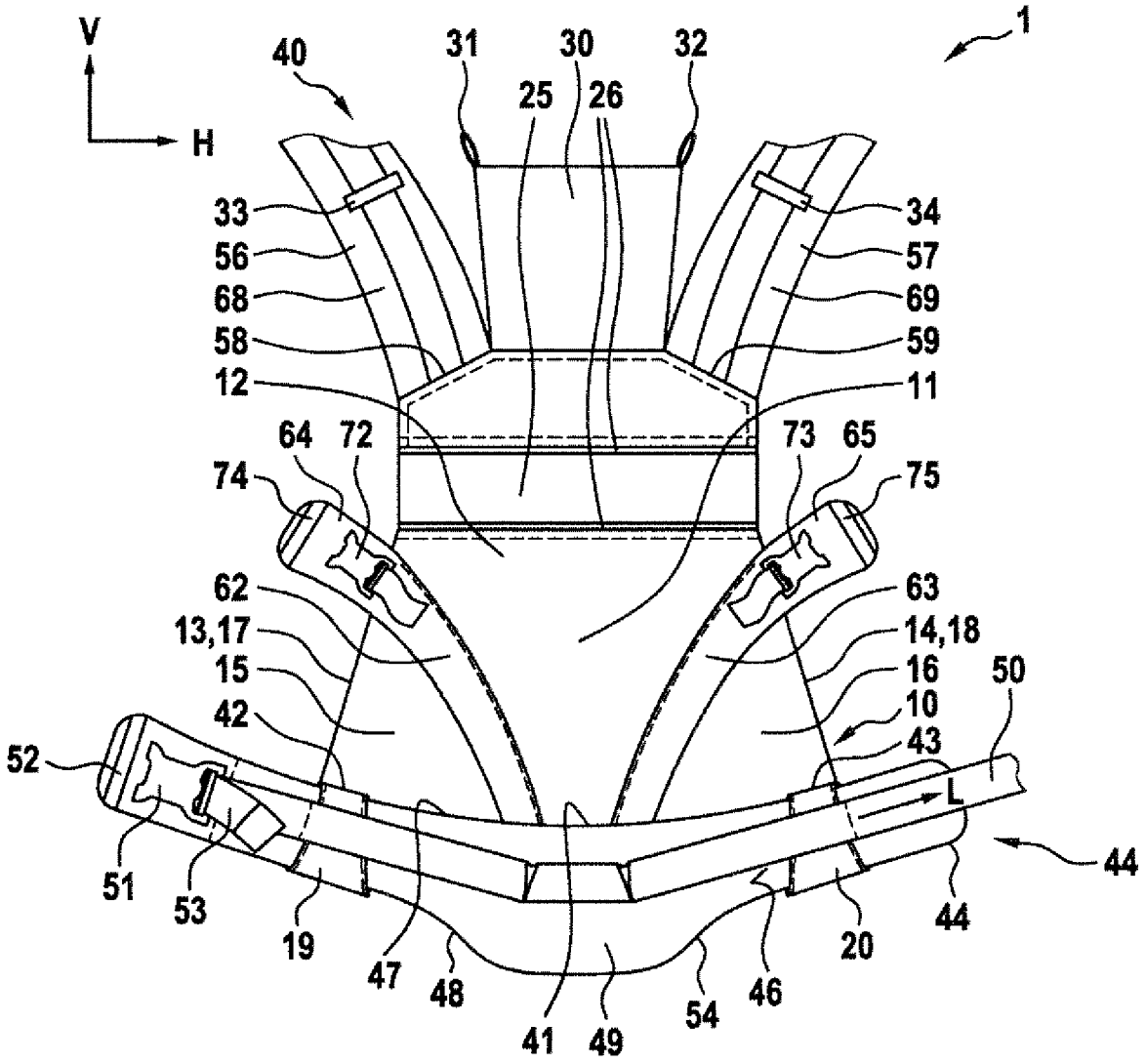
FIG. 1 shows a diagram of the external side of a carrying device in which a length extension element is situated in that position in which said length extension element lengthens the receptacle member of the carrying device in the height direction, and in which widening elements are situated in a position of maximum width.
Figure 2:
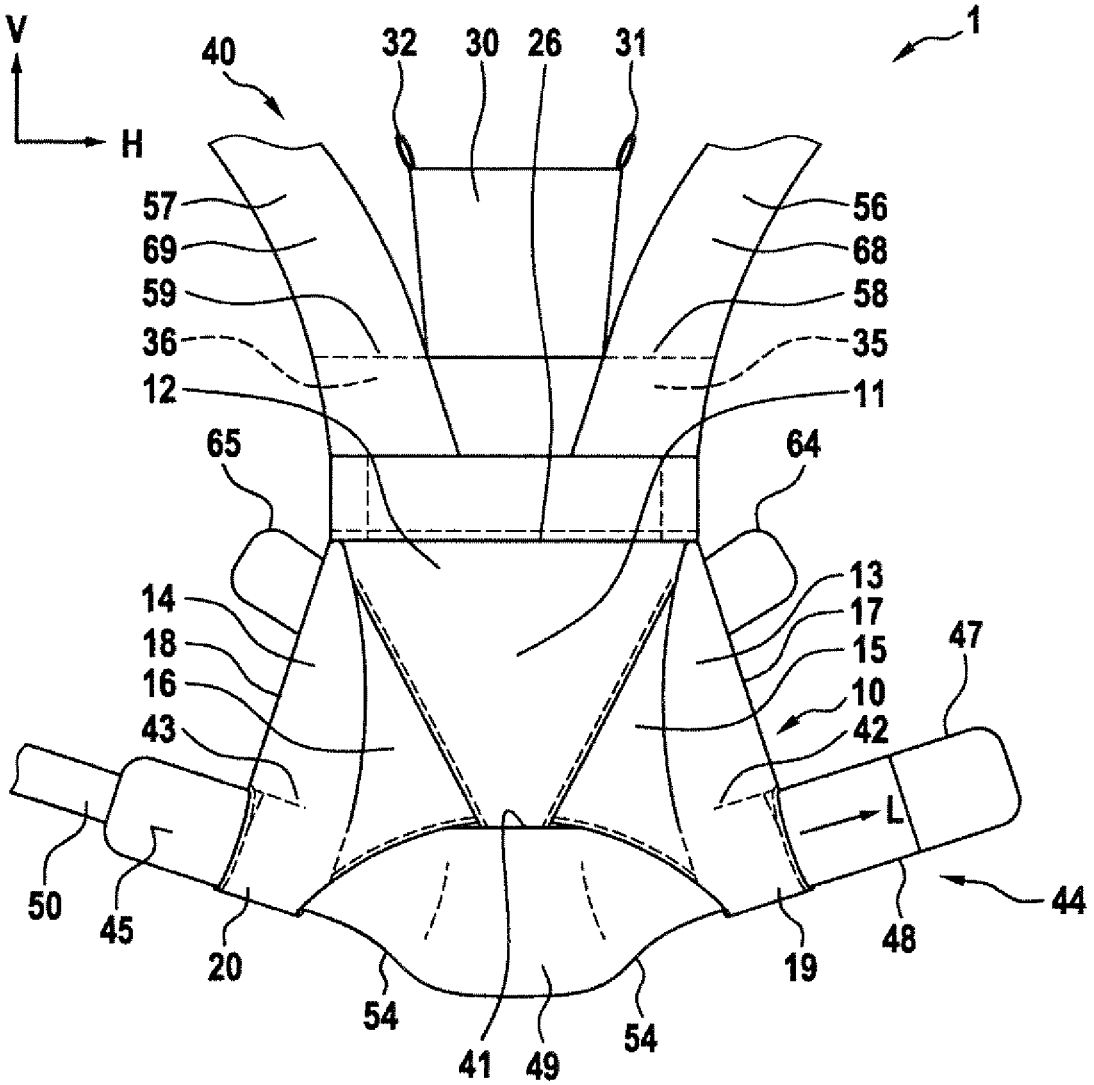
FIG. 2 shows a diagram of an internal side of the carrying device as per FIG. 1, in which the length extension element is situated in that position in which said length extension element does not lengthen the receptacle member of the carrying device in the height direction, and in which the widening elements continue to be situated in the position of maximum width.
Figure 3:
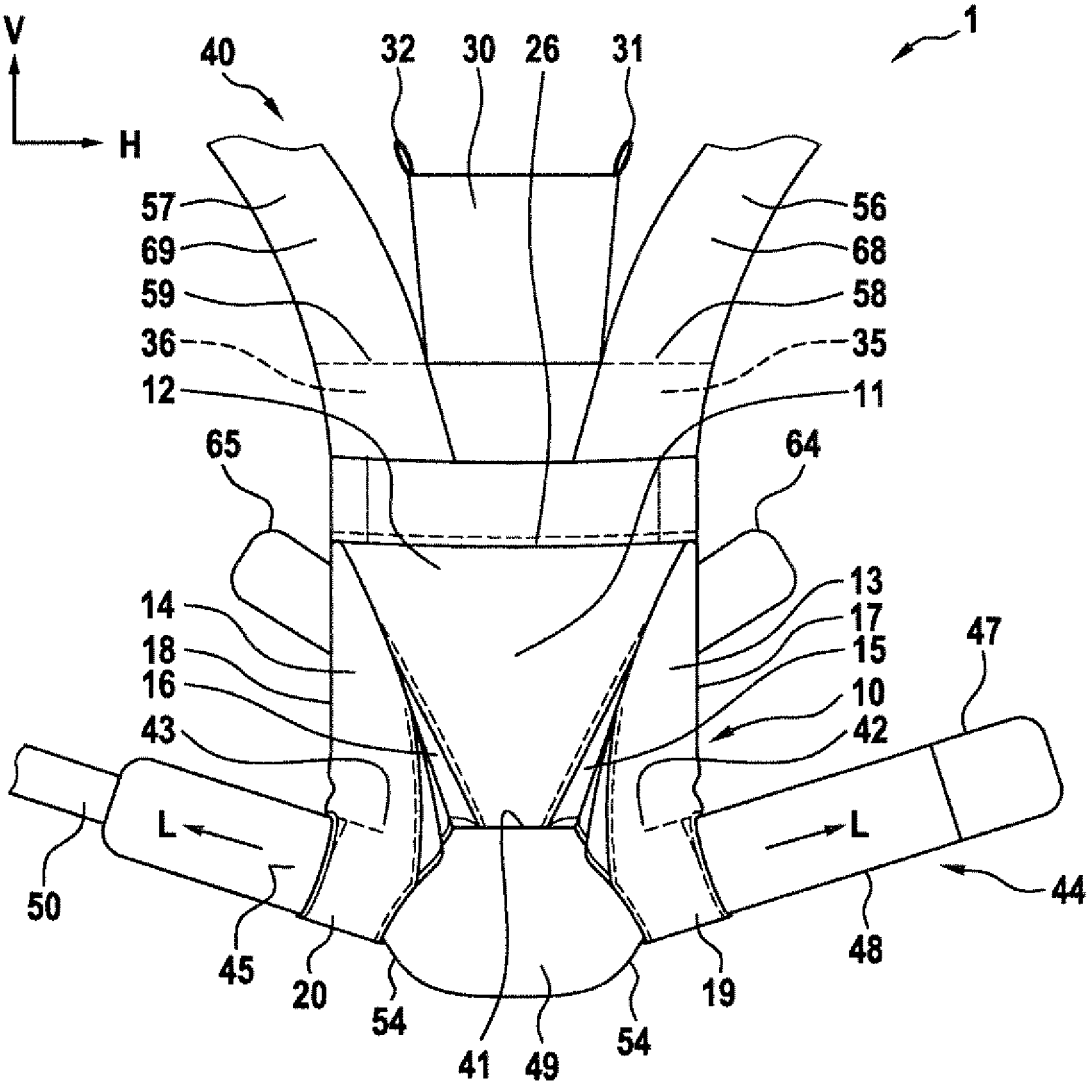
FIG. 3 shows a diagram of the internal side of the carrying device as per FIG. 2, in which the widening elements are in a position of medium width.
Figure 4:
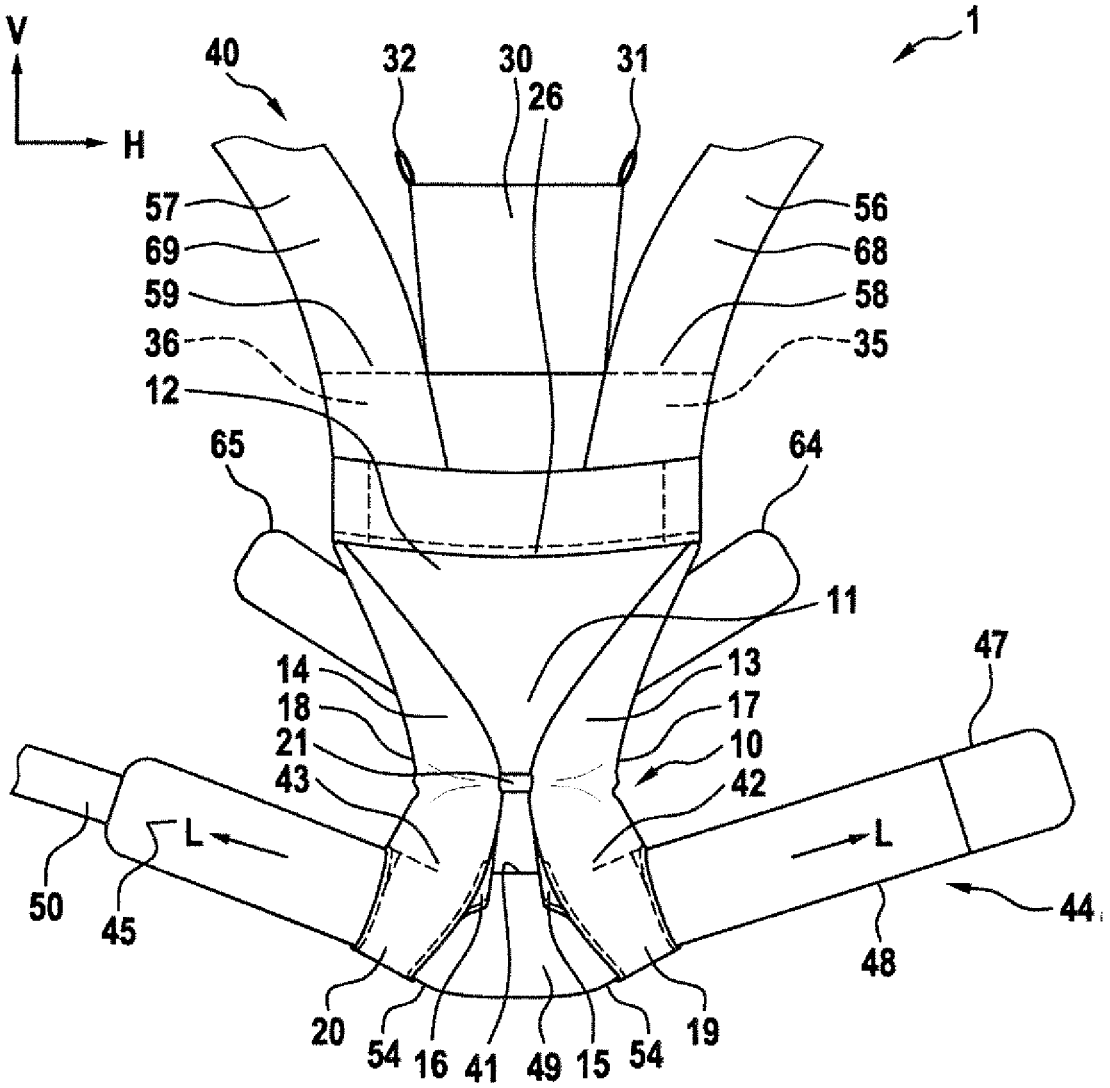
FIG. 4 shows a diagram of the internal side of the carrying device as per FIG. 3, in which the widening elements are situated in a position of minimum width.

FIGS. 1, 2, 3, and 4 include in each case a diagram of the same carrying device 1, wherein the external side is illustrated in FIG. 1 and the internal side is illustrated in FIGS. 2, 3, and 4. The same reference signs therefore relate to identical or equivalent components.

It can be seen in FIG. 1 that the carrying device 1 has a receptacle member 10 which configures a receptacle space for receiving a baby or infant. The receptacle member 10 is composed substantially of textile materials which are partially not padded and partially padded.

Moreover, the carrying device 1 possesses a holding harness system 40 for fastening the receptacle member 10 to a carrier. The holding harness system 40 has a hip strap 44 and two carrying straps 56, 57 which are configured as shoulder straps. The carrying straps 56, 57 at least in portions possess shoulder pads 68, 69. The hip strap 44 extends in a longitudinal direction L and has an internal side 45 (see FIGS. 2, 3, and 4), an external side 46, an upper edge 47, and a lower edge 48. The hip strap 44 herein has a padded strap 49 and an outer tension strap 50. The tension strap 50 possesses a closure element 51 for opening and closing, as well as a tensioning device 53 so as to be able to set the width of the hip strap 44. Furthermore, the closure element 51 is secured by a securing installation 52 which prevents immediate releasing or opening, respectively, of the hip strap 44 upon opening of the closure element 51 (the second part of the closure element 51 lies outside the image region). The securing installation 52 is configured in the manner of a sling such that the buckle first catches on the sling. However, the carrier is free to decide to not use the sling in that said carrier places the tension strap 50 across the sling instead of through the sling.

The receptacle member 10 has an non-padded central part 11 which supports the baby or infant, and which is connected to the upper edge 47 of the hip strap 44 at a first connection point 41. The central part 11 in the upper region 12 is connected indirectly to the two carrying straps 56, 57 of the holding harness system 40. On account thereof, the central part 11 lies between the upper ends 58, 59 of the two carrying straps 56, 57 and the first connection point 41, and spans the infant in a vertical manner.

The central part 11 from an upper region 12 narrows in the direction toward the hip strap 44. In particular, the central part 11 has a symmetrical basic shape of an isosceles trapezoid. The shorter of the two base sides of the trapezoidal basic shape is disposed in the region of the first connection point 41 and configures a connecting edge of the first connection point 41 to the hip strap 44. The first connection point 41 is a seam in the horizontal direction H and is thus configured so as to be non-releasable (indications of directions refer to an upright position of the carrier). The legs of the trapezoidal basic shape are configured so as to be slightly concave.

The first connection point 41 in the longitudinal direction L of the hip strap 44 is between 1 cm and 12 cm wide, preferably between 2 cm and 10 cm wide, furthermore preferably between 3 cm and 8 cm wide, even furthermore preferably between 4 cm and 7 cm wide, and particularly preferably between 4.5 cm and 6 cm wide.

The central part 11 is tensioned between two padded tension cords 62, 63 which are connected to straps 64, 65 of the holding harness system 40. The tension cords 62, 63 from the ends of the long base side of the trapezoidal basic shape run up to the first connection point 41 and are connected, or stitched, respectively, to the central part 11 across the entire length of the legs of the trapezoidal basic shape, said connecting or stitching, respectively, in particular taking place by way of the internal edges of the tension cords 62, 63. The lower ends of the carrying straps 56, 57 (not visible) may configure the straps 64, 65 that are connected to the two tension cords 62, 63. Said lower ends in this instance form carrying slings which either run so as to be mutually parallel or alternatively can be disposed in a cruciform manner.

The carrying straps 56, 57 have closure elements 72, 73 for opening and closing the carrying straps 56, 57. The closure element 72, 73 herein can be secured by a sling-type securing installation 74, 75 which prevents immediate releasing or opening, respectively, of the carrying straps 56, 57 upon opening a closure element 72, 73.

The receptacle member 10 is configured in such a manner that the height thereof is variable. To this end, the receptacle member 10 has a length extension element 25 which according to FIG. 1 is positioned in such a manner that the receptacle member 10 in the height direction is lengthened by the length extension element 25. The length extension element 25 lies between the central part 11 and the two carrying straps 56, 57. The receptacle member 10 above the length extension element 25 also possesses a terminal portion to which the carrying straps 56, 57 are fastened. The length extension element 25 is an inward fold which can be fixed by way of fixing means 26. The fixing means 26 according to FIG. 1 are released, on account of which the inward fold is pulled apart in the vertical direction V. The fixing means 26 are configured by a zip fastener which runs in the horizontal direction H. One zip fastener strip is disposed on the terminal portion, and one zip fastener strip is disposed on the long base side of the central part 11. The terminal portion, the length extension element 25, and the central part 11 preferably have one continuous material web. The length extension element 25 with the aid of the fixing means 26 can be adjusted between at least two positions, specifically a first position in which the height of the receptacle member 10 is not increased—as is shown in FIGS. 2, 3, and 4, and a second position in which the height of the receptacle member 10 is increased—as is shown in FIG. 1. In particular, the length extension element 25 can be fixed in the first position thereof by way of the fixing means 26.

The carrying device 1 furthermore has a cloth-type head part 30 which is fixedly connected to the receptacle member 10, said connecting taking place in particular along a horizontally aligned seam at the upper end of the receptacle member 10. Fastening elements 31, 32 in the form of rubber slings are disposed on the free end of the head part 30. Said rubber slings can be hooked into receptacle elements 33, 34 on the carrying straps 56, 57. To this end, the receptacle elements 33, 34 are in each case configured as a hook. The head part 30 on account of the displaceable mounting of the receptacle elements 33, 34 on the carrying straps 56, 57 can be tensioned or loosened. The head part 30 can be rolled up or folded up or gathered in the vertical direction V, and in this instance can be pushed in each case into one insertion pocket 35, 36 at the horizontally lateral ends of the head part 30, said insertion pocket 35, 36 being sewn shut between the carrying straps 56, 57 and the receptacle member (see FIGS. 2, 3, and 4).

As is derived from FIGS. 1, 2, 3, and 4, but can better be seen in FIGS. 2, 3, 4, a first and a second padded widening element 13, 14 is connected to the central part 11 in the upper region of the central part 11 of the external side, in particular at the ends of the long base side of the trapezoidal basic shape, said connecting taking place in particular in a non-adjustable and non-releasable manner. The ends of the long base side of the trapezoidal basic shape form the opposite ends of the upper region 12. The first widening element 13 extends to a second connection point 42 to the hip strap 44, the position of said second connection point 42 being able to be adapted in a stepless manner by displacing the first widening element 13 along the hip strap 44. The second widening element 14 likewise extends to a third connection point 43 to the hip strap 44, the position of said third connection point 43 being able to be adapted in a stepless manner by displacing the second widening element 14 along the hip strap 44. The first connection point 41 lies between the second and the third connection point 42, 43. Moreover, the first and the second widening element 13, 14 extend in the direction of the upper edge 47 of the hip strap 44.

In this way, a widening of the seat can be effected by longitudinally displacing the first and the second widening element 13, 14 along the longitudinal direction L of the hip strap 44 as well as away from the first connection point 41. The maximum adjustable seat width is shown in FIGS. 1 and 2. Conversely, a narrowing of the seat can be effected by longitudinally displacing the first and the second widening element 13, 14 along the longitudinal direction L of the hip strap 44 as well as in the direction of the first connection point 41. FIG. 3 shows a setting of medium width, and FIG. 4 shows the narrowest possible seat width.

As is seen in FIGS. 1, 2, 3, and 4 the second and the third connection point 42, 43 has in each case one sling 19, 20 which is disposed on the widening elements 13, 14 and is mounted so as to be displaceable on the hip strap 44. The widening elements 13, 14 are in each case configured so as to be tape-shaped and on the internal side 45 as well as on the upper edge 47 of the hip strap 44 transition to the slings 19, 20.

The slings 19, 20 in the longitudinal direction L of the hip strap 44 as well as on the lower edge 48 of the hip strap 44 are configured so as to be wide, in particular at least 2 cm, preferably at least 3 cm, furthermore preferably at least 4 cm, and particularly preferably at least 5 cm wide. When comparing FIGS. 1 and 2 it can be seen that the slings 19, 20 in the region of the lower edge 48 of the hip strap 44 on the internal side 45 and on the external side 46 have in each case substantially identical widths. At least no abrupt change in terms of the width is present here. This is however not the case on the upper edge 47 of the hip strap 44. The slings 19, 20 here on the internal side 45 of the hip strap 44 are in each case configured so as to be wider than on the external side 46. The region of the slings 19, 20 which is disposed on the internal side 45 as well as on the upper edge 47 of the hip strap 44 in the direction toward the first connection point 41 projects beyond the region of the sling 19, 20 which is disposed on the external side 46 as well as on the upper edge 47. As can be seen in FIG. 4, on account thereof the first and the second widening element 13, 14 on the internal side 45 of the hip strap 44 are in each case at least in part able to be slid up to just before the first connection point 41. The minimal spacing that is able to be set between the external edges 17, 18 of the first and the second widening element 13, 14 in the region of the hip strap 44 in this instance corresponds substantially to the width of the first connection point 41 plus the width of the two slings 19, 20 on the external side 46 in the region of the upper edge 47 of the hip strap 44.

As is derived from FIG. 4, a fixing installation 21 by way of which the spacing of the widening elements 13, 14 from the hip strap 44 is able to be delimited is moreover provided. Said fixing installation 21 is composed of two string ends which can be knotted to one another and which are in each case fastened to one of the widening elements 13, 14.

A stop 54 for avoiding stress peaks on account of contact between the connection points 41, 42, 43 beyond which the second and the third connection point 42, 43 are not able to be longitudinally displaced farther toward one another is provided. The stop 54 is configured by a widening of the hip strap 44, in particular of the padded strap 49.

The first connection point 41 being disposed in a depression of the upper edge 47 of the hip strap 44 moreover contributes towards achieving this very narrow seat width, on account of which the slings 19, 20 are inclined obliquely inward in the direction of the first connection point 41. On account thereof, the friction of the slings 19, 20 on the hip strap 44 is also increased such that the stress on account of the received child does not lead to the slings 19, 20 being displaced.

The padded strap 49 according to FIG. 1 is disposed in the slings 19, 20 and has a substantially homogenous width across the displacement path. The tension strap 50 of the hip strap 44 lies outside the slings 19, 20. The tension strap 50 and the padded strap 49 are not connected to one another across the length of the displacement path.

In the case of a practically oriented dimensional layout as is shown in FIG. 4, the second and the third connection point 42, 43 are able to be displaced toward one another so far that external edges 17, 18 of the first and the second widening element 13, 14 in the region of the hip strap 44 have a mutual spacing between 14 cm and 28 cm, furthermore preferably between 16 cm and 27 cm, even furthermore preferably between 18 cm and 26 cm, and particular preferably between 20 cm and 24 cm. As can be seen in FIG. 3, the second and the third connection point 42, 43 are also able to be displaced toward one another so far that the external edges 17, 18 of the first and the second widening element 13, 14 run toward one another in the direction toward the hip strap 44.

Conversely, the second and the third connection point 42, 43 are able to be displaced outwards so far that the external edges 17, 18 of the first and the second widening element 13, 14 diverge in the direction toward the hip strap 44 (see FIGS. 1 and 2). For a practically oriented dimensional layout, the second and the third connection point 42, 43 should be able to be longitudinally displaced away from one another so far that the external edges 17, 18 of the widening elements 13, 14 in the region of the hip strap 44 have a mutual spacing between 30 cm and 55 cm, furthermore preferably between 35 cm and 50 cm, even furthermore preferably between 37 cm and 47 cm, and particularly preferably between 40 and 45 cm.

It can furthermore be seen in FIGS. 1, 2, 3, and 4 that an intermediate piece 15, 16 which does not have any connection, in particular any fixed connection, to the hip strap 44 is in each case tensioned between the first and the second widening element 13, 14 and the central part 11. The intermediate pieces 15, 16 widen in each case in the direction toward the hip strap 44 and have in each case a substantially triangular basic shape. The external edges 17, 18, but not the internal edges, of the widening elements 13, 14 are in each case connected to the respective intermediate piece 15, 16. The widening elements 13, 14 herein lie in each case on the internal side in front of the associated intermediate piece 15, 16. As can be seen in FIGS. 3 and 4, said intermediate piece 15, 16 can fold, wherein the child is in contact with the widening elements 13, 14 primarily on the internal side. The widening elements 13, 14 are preferably padded, and the intermediate pieces 15, 16 are preferably not padded.

Furthermore, a corner of the intermediate pieces 15, 16 of the internal side 45 extends in each case below the upper edge 47 of the hip strap 44, in particular into the region of the lower edge 48. The intermediate pieces 15, 16 in this region are laterally connected to the slings 19, 20. On account thereof, the intermediate pieces 15, 16 when stressed are tensioned by way of the upper edge 47 of the hip strap 44 and are able to support the infant. Moreover, the infant is not in direct contact with the external side 46 of the hip strap 44 between the second and the third connection point 42, 43.

The receptacle member 10 thus does not possess any additional element which is disposed between the baby or infant and the carrier. On account thereof, direct physical contact is possible between the carrier and the baby or infant. The baby or infant by way of the posterior region sits substantially on the central part 11 and between the widening elements 13, 14 which conjointly configure a type of pocket. The thighs up to the hollows of the knees bear on the widening elements 13, 14, and the thighs in the case of the correct setting of the seat width are slightly spread in an anatomically correct manner.

The construction of the holding harness system 40 permits an infant to be carried in various positions. The following variants are possible herein:

i. the receptacle member 10 is disposed on the stomach of the carrier, wherein the carrying straps 56, 57 cross one another on the back;

ii. the receptacle member 10 is disposed on the stomach of the carrier, wherein the carrying straps 56, 57 are shaped so as to form slings and do not cross one another;

iii. the receptacle member 10 is disposed on the back of the carrier, wherein the carrying straps 56, 57 are shaped so as to form slings and do not cross one another;

iv. the receptacle member 10 is disposed on the back of the carrier, wherein the carrying straps 56, 57 cross one another on the chest; and v. the receptacle member 10 is disposed laterally on the hip of the carrier, wherein one of the carrying straps 56, 57 is closed in an oblique manner across the shoulder, and the other carrying strap 56, 57 is closed in a vertical manner at the back.

In all positions, the baby or infant can sit in the receptacle member 10 so as to face the carrier. However, receiving the baby or infant in the receptacle member 10 so that said the baby or infant faces away from the carrier is also possible in particular when the receptacle member 10 is carried on the stomach of the carrier.

The carrying device 1 according to the invention guarantees an orthopedically correct carrying mode which is adapted to the requirements of the infant as well as to those of the carrier. Infants of most diverse sizes, in particular also new-born infants, can be received in the carrying device 1 according to the invention on account of the various setting variants which are enabled by the length extension element 25 for lengthening the receptacle member 10 and the seat width setting. The carrying device 1 has a very low weight and can be folded to a small size.

The invention is not limited to any of the embodiments described above, but can be modified in many ways.

Inter alia, the carrying strap 56, 57 can have an adjustment installation for varying the strap length. A further setting possibility can optionally be provided in that the carrying straps 56, 57 have at least one adjustment installation for varying the effective length of the shoulder pads 68, 69. In this way, not only is strap length adapted to the physique of the carrier, but the position of the padded portions can also be adjusted.

Moreover, the holding harness system 40 can have a chest strap which is fastened to the carrying straps 56, 57. Such a chest strap prevents that slings of the carrying straps 56, 57 that are worn in parallel slip from the shoulders of the carrier. Such a chest strap should have an adjustment installation for varying the strap length, and a closure element for opening and closing the chest strap. The chest strap is preferably mounted on the carrying straps 56, 57 so as to be displaceable in the direction of extent of said carrying straps 56, 57. A comfortable position can be set on account thereof.

All features and advantages, including constructive details, spatial arrangements, and method steps, which are derived from the claims, the description, and the drawing can be relevant to the invention individually as well is in the most varied combinations.

LIST OF REFERENCE SIGNS

1 Carrying device
10 Receptacle member
11 Central part
12 Upper region
13 First widening element
14 Second widening element
15 First intermediate piece
16 Second intermediate piece
17 External edge of the first widening element
18 External edge of the second widening element
19 First sling (second connection point)
20 Second sling (third connection point)
21 Fixing installation (of the widening elements)
25 Length extension element
26 Fixing means (length extension element)
30 Head part
31 First fastening element (head part)
32 Second fastening element (head part)
33 First receptacle element (for the first fastening element of the head part)
34 Second receptacle element (for the second fastening element of the head part)
35 First insertion pocket
36 Second insertion pocket
40 Holding harness system
41 First connection point
42 Second connection point
43 Third connection point
44 Hip strap
45 internal side (hip strap)
46 External side (hip strap)
47 Upper edge (hip strap)
48 Lower edge (hip strap)
49 Padded strap (hip strap)
50 Tension strap (hip strap)
51 Closure element (hip strap)
52 Securing installation (closure element of the hip strap)
53 Tensioning device (hip strap)
54 Stop
56 First carrying strap (holding harness system)
57 Second carrying strap (holding harness system)
58 Upper end (first carrying strap)
59 Upper end (second carrying strap)
62 First tension cord
63 Second tension cord
64 First strap (holding harness system, transition to the tension cord)
65 Second strap (holding harness system, transition to the tension cord)
68 Shoulder pad (first carrying strap)
69 Shoulder pad (second carrying strap)
72 Closure element (first carrying strap)
73 Closure element (second carrying strap)
74 Securing installation (closure element of the first carrying strap)
75 Securing installation (closure element of the second carrying strap)
H Horizontal
L Longitudinal direction (hip strap)
V Vertical

The invention claimed is:

1. A carrying device (1) having a receptacle member (10) which configures a receptacle space for receiving a baby or infant, and having a holding harness system (40) for fastening the receptacle member (10) to a person, wherein the holding harness system (40) has a hip strap (44), and wherein the receptacle member (10) has a central part (11) which supports the baby or infant and which is connected to the hip strap (44) at a first connection point (41), wherein the central part (11) from an upper region (12) narrows in the direction toward the hip strap (44); and in the upper region (12) a first and a second widening element (13, 14), are connected to the central part (11)

being mutually spaced apart on an external side, or laterally, respectively, or on an outer periphery in the upper region (12);

wherein the first widening element (13) extends to a second connection point (42) to the hip strap (44), the position of said second connection point (42) being able to be adapted by sliding the first widening element (13) along the hip strap (44) in a stepless manner;

wherein the second widening element (14) extends to a third connection point (43) to the hip strap (44), the position of said third connection point (43) being able to be adapted by sliding the second widening element (14) along the hip strap (44) in a stepless manner;

wherein the second and the third connection point (42, 43) have in each case one non-gathering sling (19, 20) which is disposed on the widening elements (13, 14) and is mounted so as to be slideable on the hip strap (44) in a stepless and non-gathering manner; and wherein the hip strap (44) comprises a padded strap (49) and an outer tension strap (50), wherein the padded strap (49) is disposed in and extends through the non-gathering slings (19, 20); and wherein widths of gaps between the first and the second connection points, the first and the third connection points, and the second and third connection points along the hip strap (44) are able to be set in a stepless manner.

2. The carrying device (1) as claimed in claim 1, further comprising a first intermediate piece (15) which does not have any connection to the hip strap (44) is tensioned between the first widening element (13) and the central part (11), and a second intermediate piece (16) which does not have any connection to the hip strap (44) is tensioned between the second widening element (14) and the central part (11), and wherein triangular gaps created between the central part (11) and the widening elements (13, 14) when the widening elements (13, 14) are pulled apart are filled by one of the first and second intermediate pieces (15, 16), respectively.

3. The carrying device (1) as claimed in claim 2, characterized in that the first and second intermediate pieces (15, 16) widen in each case in the direction toward the hip strap (44).

4. The carrying device (1) as claimed in claim 2, characterized in that the first and second intermediate pieces (15, 16) have in each case a substantially triangular basic shape.

5. The carrying device (1) as claimed in claim 1, characterized in that the central part (11) is connected to the hip strap (44) in a non-adjustable manner at the first connection point (41).

6. The carrying device (1) as claimed in claim 1, characterized in that the first connection point (41) in the longitudinal direction (L) of the hip strap (44) is between 1 cm and 12 cm wide.

7. The carrying device (1) as claimed in claim 1, characterized in that the second and the third connection point (42, 43) are able to be slid toward one another so far that external edges (17, 18) of the first and the second widening element (13, 14) in the region of the hip strap (44) have a mutual spacing between 14 cm and 28 cm.

8. The carrying device (1) as claimed in claim 1, characterized in that the second and the third connection point (42, 43) are able to be slid toward one another so far that external edges (17, 18) of the first and the second widening element (13, 14) converge in the direction toward the hip strap (44).

9. The carrying device (1) as claimed in claim 1, characterized in that the second and the third connection point (42, 43) are able to be slid outward so far that external edges (17, 18) of the first and the second widening element (13, 14) diverge in the direction toward the hip strap (44).

10. The carrying device (1) as claimed in claim 1, characterized in that the second and the third connection point (42, 43) are able to be longitudinally slid so far from one another that external edges (17, 18) of the widening elements (13, 14) in the region of the hip strap (44) have a mutual spacing between 30 cm and 55 cm.

11. The carrying device (1) as claimed in claim 1, characterized in that a stop (54) beyond which the second and the third connection point (42, 43) are not able to be longitudinally slid closer from one another is configured.

12. The carrying device (1) as claimed in claim 1, characterized in that the non-gathering slings (19, 20) in the longitudinal direction (L) of the hip strap (44), as well as on a lower edge (48) of the hip strap (44), are configured to be at least 2 cm wide.

13. The carrying device (1) as claimed in claim 1, characterized in that the non-gathering slings (19, 20) in the region of an upper edge (47) of the hip strap (44) are in each case configured so as to be wider on an internal side (45) of the hip strap (44) than on an external side (46).

14. The carrying device (1) as claimed in claim 1, characterized in that the non-gathering slings (19, 20) on an internal side (45) as well as on an upper edge (47) of the hip strap (44) are in each case connected to one of the widening elements (13, 14).

15. The carrying device (1) as claimed in claim 1, characterized in that the first connection point (41) is disposed in a depression of an upper edge (47) of the hip strap (44), whereas the slings (19, 20) are inclined obliquely inward in a direction of the first connection point (41) such that a tensile force of the non-gathering slings (19, 20) acts by way of an obtuse angle on a lower edge (48) of the hip strap (44), which is in the adjustment region running parallel with an upper edge (47) of the hip strap (44).

16. The carrying device (1) as claimed in claim 1, characterized in that the outer tension strap (50) lies outside the non-gathering slings (19, 20), such that the sling (19, 20) is jammed between the padded strap (49) and the tension strap (50) by way of fixing the tension strap (50), respectively.

17. The carrying device (1) as claimed in claim 1, characterized in that the central part (11) has a trapezoidal basic shape, and wherein a shorter of two base sides of the trapezoidal basic shape is disposed in a region of the first connection point (41) or configures a connecting edge of the first connection point (41).

18. The carrying device (1) as claimed claim 1, characterized in that the central part (11) is tensioned between two tension cords (62, 63) which are connected to straps (64, 65) of the holding harness system (40), wherein the tension cords (62, 63) run up to the first connection point (41).

19. The carrying device (1) as claimed in claim 1, characterized in that the central part (11) in the upper region (12) is connected indirectly or directly to two carrying straps (56, 57) of the holding harness system (40), such that the central part (11) lies between upper ends of the two carrying straps (56, 57) and the first connection point (41), and is tensioned therebetween.

20. The carrying device (1) as claimed in claim 1, characterized in that a fixing installation (21) by way of which the spacing between the widening elements (13, 14) is able to be delimited is provided.

21. The carrying device (1) as claimed in claim 1, characterized in that the receptacle member (10) is configured in such a manner that a height thereof is variable.

22. The carrying device (1) as claimed in claim 1, characterized in that said carrying device (1) has a head part (30).

* * * * *